US006749065B1

(12) United States Patent
Hammett

(10) Patent No.: US 6,749,065 B1
(45) Date of Patent: Jun. 15, 2004

(54) MULTI-PACK NESTABLE CASE

(75) Inventor: Roy Hammett, Odessa, FL (US)

(73) Assignee: Norseman Plastics Limited, Ontario (CA)

( * ) Notice: Subject to any disclaimer, the term of this patent is extended or adjusted under 35 U.S.C. 154(b) by 0 days.

(21) Appl. No.: 09/607,966

(22) Filed: Jun. 30, 2000

(51) Int. Cl.[7] ..... B65D 21/04
(52) U.S. Cl. ..... 206/509; 220/509; 220/519
(58) Field of Search ..... 206/509, 503, 206/508, 510; 220/509, 515, 516, 519, 675, 671

(56) References Cited

U.S. PATENT DOCUMENTS

| | | | | | |
|---|---|---|---|---|---|
| 4,548,320 | A | * | 10/1985 | Box | 206/509 |
| D317,670 | S | | 6/1991 | Apps | |
| D318,552 | S | | 7/1991 | Apps | |
| 5,060,819 | A | * | 10/1991 | Apps | 206/509 |
| D329,932 | S | | 9/1992 | Apps | |
| 5,184,748 | A | | 2/1993 | Apps | |
| 5,267,649 | A | | 12/1993 | Apps et al. | |
| 5,305,884 | A | | 4/1994 | Apps et al. | |
| 5,316,172 | A | | 5/1994 | Apps et al. | |
| D355,764 | S | | 2/1995 | Apps | |
| D356,211 | S | | 3/1995 | Apps et al. | |
| D356,679 | S | | 3/1995 | Apps et al. | |
| 5,415,293 | A | * | 5/1995 | Ackermann et al. | 206/505 |
| D361,663 | S | | 8/1995 | Kalin | |
| 5,445,273 | A | | 8/1995 | Apps | |
| 5,495,945 | A | | 3/1996 | Apps et al. | |
| 5,501,352 | A | * | 3/1996 | Apps | 206/144 |
| 6,041,927 | A | * | 3/2000 | Vallve et al. | 206/427 |
| 6,131,730 | A | | 10/2000 | Hsu | |
| 6,237,758 | B1 | | 5/2001 | Hsu | |

* cited by examiner

*Primary Examiner*—Stephen Castellano
(74) *Attorney, Agent, or Firm*—Nixon & Vanderhye P.C.

(57) ABSTRACT

A case for carrying a plurality of bottles comprising a pair of side walls and a pair of end walls connected to a case bottom having a plurality of bottle supporting platforms, the side walls and the end walls having a lower part including a plurality of panels separated by windows and an upper part including a substantially solid band, the solid band in the end walls having handle-forming openings therein; wherein the panels are each provided on interior surfaces thereof with a pair of relatively thick, vertically extending and laterally spaced ribs, the ribs having edges facing radially towards centers of adjacent bottle supporting platforms; and wherein the solid band is provided on an interior surface thereof with a plurality of vertically extending buttresses, each directly above a respective window.

34 Claims, 12 Drawing Sheets

MULTI-PACK NESTABLE CASE

TECHNICAL FIELD

This invention relates to low depth, plastic cases used for carrying bottles and, specifically, to a new case construction for individual bottles.

BACKGROUND

It is well known to utilize plastic cases for carrying glass or plastic bottles of various sizes and shapes. Such cases are often designed to carry a particular size bottle in what is sometimes referred to as a "low-depth" case, i.e., a case having relatively low peripheral wall (side and end walls) with the bottles extending above the peripheral wall. This means that the bottles themselves support adjacent cases when vertically stacked. These cases also have underside profiles that provide recesses for the bottle tops of underlying cases in order to add stability. Another feature of these cases is the ability to nest when empty, thereby conserving space during shipping and storage. Examples of prior low depth cases may be found in U.S. Pat. Nos. 5,842,572; 5,823,376; 5,184,748 and 5,060,819.

Continuing concerns relate to material costs, case strength, bottle support and stability as well as the handling of the cases empty or filled.

SUMMARY OF THE INVENTION

This invention provides a low depth case that is designed for strength, good bottle support and stability when the crates are used individually, but also when several filled crates are stacked, one on top of the other. The various bottle support surfaces within the case are designed to minimize surface contact, and thereby also minimize bottle surface abrasion. The case disclosed herein is also designed to permit cross stacking and to facilitate pulling the top case off a stack of filled similar cases.

Specifically, the case in accordance with this invention is of one piece molded plastic construction, and includes a relatively flat open-grid type bottom which is connected about its periphery to a pair of side walls and a pair of end walls (also generally referred to as a peripheral case wall). The peripheral case wall has upper and lower regions, with the upper region including a solid band or rail and the lower region including a plurality of spaced panel sections. In other words, the upper band or rail is supported by the plurality of side and end wall panel sections that are located at laterally spaced apart locations about the periphery of the lower region of the case. As a result, windows are formed in the lower region of the peripheral case wall. The case is sized to accommodate four longitudinal rows of 20 oz. bottles with six bottles in each longitudinal row. Alternatively stated, the case accommodates six transverse rows of bottles with four bottles in each transverse row. The case will, however, also accommodate bottles of different size, e.g., 16 oz., 24 oz., etc. but having substantially identical diameters. The open-grid case bottom is designed to provide a distinct, albeit flat, bottle supporting platform for each bottle in the case.

Interiorly of the case peripheral wall, four columns extend upwardly from the case bottom in a symmetrical pattern, each column lying in the center of an array of four bottle supporting platforms, but with no columns located along either of the longitudinal or transverse center lines of the case. As a result, 16 of the 24 bottles will be supported by one side of one column. The remaining eight bottles receive lateral support only from the side end or end walls (and, of course, from adjacent bottles).

The four columns extend upwardly only through the height of the lower region, i.e., to the bottom of the upper peripheral rail. In addition, it will be appreciated that the case configuration would otherwise permit carrying of four six-pack cartons, but the presence of the columns within the interior of the case prevents the carrying of such cartons. Thus, the case is designed for use only with individual bottles, or with multi-packs having top grips.

As already mentioned, the upper surface of the case bottom is flat (except for the columns), with the open grid designed to provide bottle supporting areas or "platforms" for each bottle received within the case. The underside of the case bottom, however, is provided with recessed areas underlying each of the bottle supporting platforms, for receiving the bottle caps of bottles (or tops of the bottles if the latter are empty) contained in an underlying case, when the cases are vertically stacked. These recesses are formed with flat center areas, larger than the bottle tops or caps, thus providing stability but allowing room for the bottles to adjust, particularly when the cases are cross-stacked, an arrangement which results in the bottles of adjacent cases being slightly offset.

The side walls and end walls that make up the peripheral case wall are generally similar except for the presence of handle openings formed in the end walls. The band or rail in the upper region of the peripheral case wall is of alternating double/single walled construction, whereas the side and end wall panel sections in the lower region are of single wall construction. Thus, the peripheral band or rail overhangs the lower side and end wall panel sections. The lower side and end wall panel sections are also tapered slightly inwardly to facilitate stacking of similar empty cases. When empty cases are stacked, the lower, outer edge of the upper peripheral rail of one case rests on the upper edge of the upper peripheral rail of the underlying case. Thus, the lower side and end wall panel sections nest only within the upper rail of the underlying case, such that the case bottom does not engage the columns of the underlying case.

The interior of the peripheral case wall is formed with a repeating surface pattern configuration in both the upper and lower regions thereof. The interior of the lower side and end wall panel sections are each provided with a pair of relatively thick, vertically extending and laterally spaced ribs that provide support, respectively, for two bottles on adjacent support platforms. The bottle supporting surface of each rib is a concavely shaped edge that faces toward the center of the respective bottle supporting platform.

The interior of the upper rail or band is interrupted by a plurality of spaced inwardly directed buttresses, each of which is centered directly over a respective window in a lower side or end wall, and hence, laterally offset from the pairs of ribs on the lower side or end wall panel sections. The interior surface of each buttress is concave in an inward facing direction, and tapers slightly outwardly and upwardly in an upper section of the buttress. This tapered region is provided with a pair of thin upstanding, laterally spaced ribs, each having a convex facing surface. These ribs continue down through the lower section of the buttress, along the vertically concave surface. The ribs in the upper section of the buttress merely serve to guide a bottle as it is inserted into the case. Once seated in the case, the bottle is laterally supported in part by both of the thin vertical ribs in the lower section of the buttress.

Each column within the interior of the case has four sides of equal width, so that the column has an essentially square cross sectional shape. The columns are skewed, however, by approximately 45°, so that the corners of each column project toward four adjacent bottle supporting platforms. Each of the column sides is also formed with a pair of vertically extending ribs extending upwardly from the case bottom to the top of the column. Each pair of ribs provides line or tangential support for a bottle seated in a respective one of the four adjacent bottle supporting platforms.

Thus, it will be appreciated that the support surfaces for bottles seated within the case are all configured as relatively thin ribs, minimizing surface contact with the bottles themselves, and thereby also minimizing the possibility of abrasion of the bottle surfaces. The bottles are also less likely to be jammed or wedged within the case, because surface contact with the bottles has been minimized, thereby also reducing friction.

Accordingly, in its broader aspects, the present invention relates to a case for carrying a plurality of bottles comprising a pair of side walls and a pair of end walls connected to a case bottom having a plurality of bottle supporting platforms, the side walls and the end walls having a lower part including a plurality of panels separated by windows and an upper part including a substantially solid band, the solid band in the end walls having handle-forming openings therein; wherein the panels are each provided on interior surfaces thereof with a pair of relatively thick, vertically extending and laterally spaced ribs, the ribs having edges facing radially towards centers of adjacent bottle supporting platforms.

In another aspect, the present invention relates to a case for carrying a plurality of bottles comprising a pair of side walls and a pair of end walls connected to a case bottom having a plurality of bottle supporting platforms, the side walls and the end walls having a lower part including a plurality of panels separated by windows and an upper part including a substantially solid band, the solid band in the end walls having handle-forming openings therein; and wherein the solid band is provided on an interior surface thereof with a plurality of vertically extending buttresses, each directly above a respective window; and further wherein each of the buttresses is provided with a pair of vertically extending ribs centered on an adjacent bottle supporting platform.

Other objects and advantages will become apparent from the detailed description that follows.

DETAILED DESCRIPTION OF THE DRAWINGS

Figure 1:
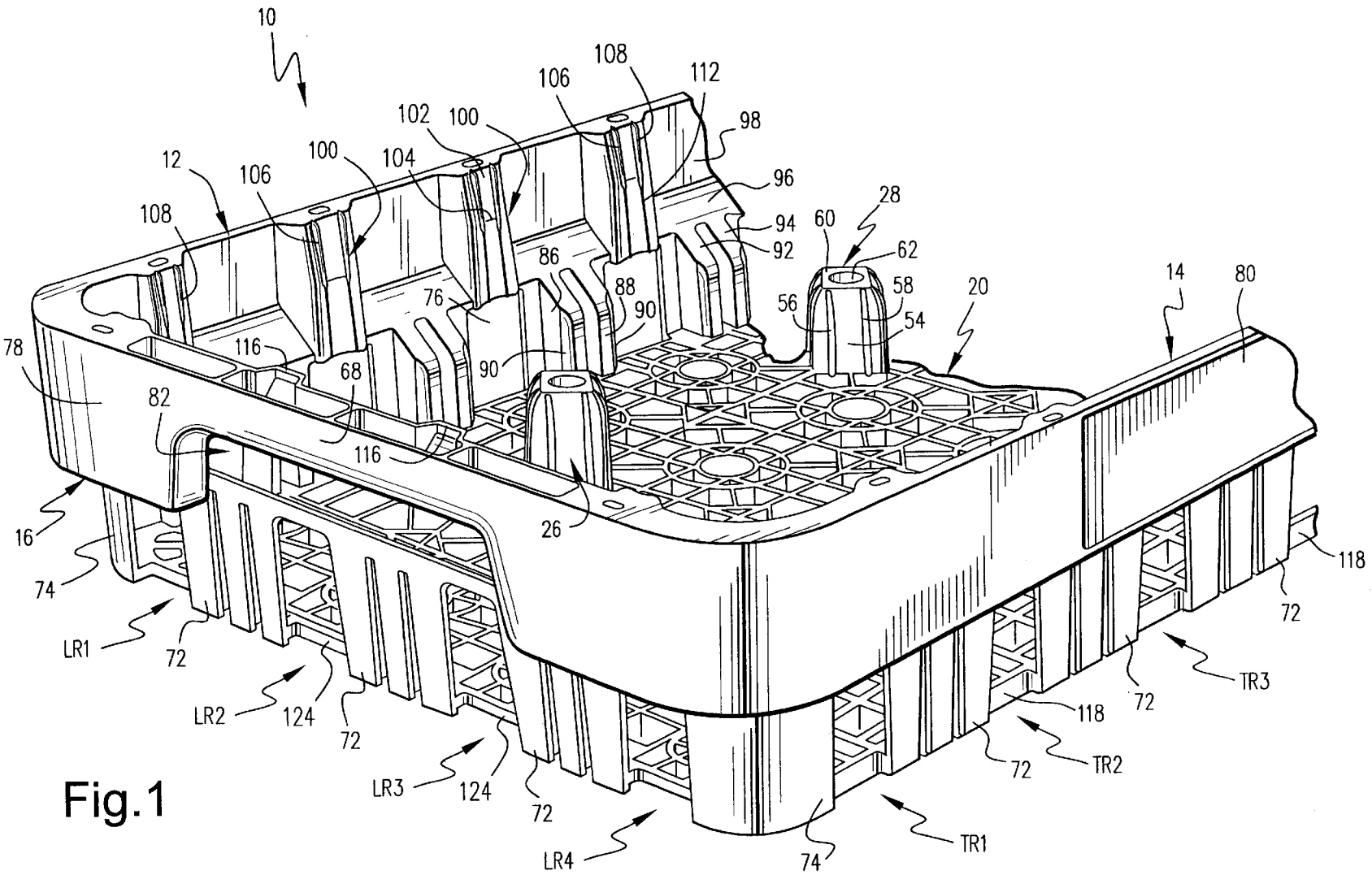
FIG. 1 is a partial perspective view of a bottle case in accordance with the invention.

With reference initially to FIGS. 1–4, the case 10 is of one-piece molded plastic construction, with a pair of side walls 12, 14; a pair of end walls 16, 18 that together comprise the case peripheral wall; and a bottom 20. The case is configured to include four longitudinal rows LR1, LR2, LR3 and LR4 of bottle supporting platforms, with six platforms in each longitudinal row. Alternatively, there are six transverse rows TR1, TR2, TR3, TR4, TR5 and TR6 with four bottle supporting platforms in each transverse row. Four columns 22, 24, 26 and 28 extend upwardly from the case bottom 20, in a symmetrical pattern, best appreciated from FIG. 2 which illustrates one half of the case, the other half being a mirror image thereof. Columns 22, 24 are located between longitudinal rows LR1 and LR2 and between transverse rows TR2, TR3, and TR4, TR5, respectively. Thus, there are no columns along either the longitudinal or transverse center lines of the case. As further described herein, each column 22, 24, 26, 28 lies in the center of an array of four bottle supporting platforms, so that sixteen of the twenty-four bottles will be supported laterally by one side of one column. The remaining eight bottles are located in transverse rows TR1 and TR6 and receive lateral support from the side walls 12, 14 and/or end walls 16, 18 as also described further herein. Of course, all of the bottles provide some degree of lateral support for each other.

Figure 2:
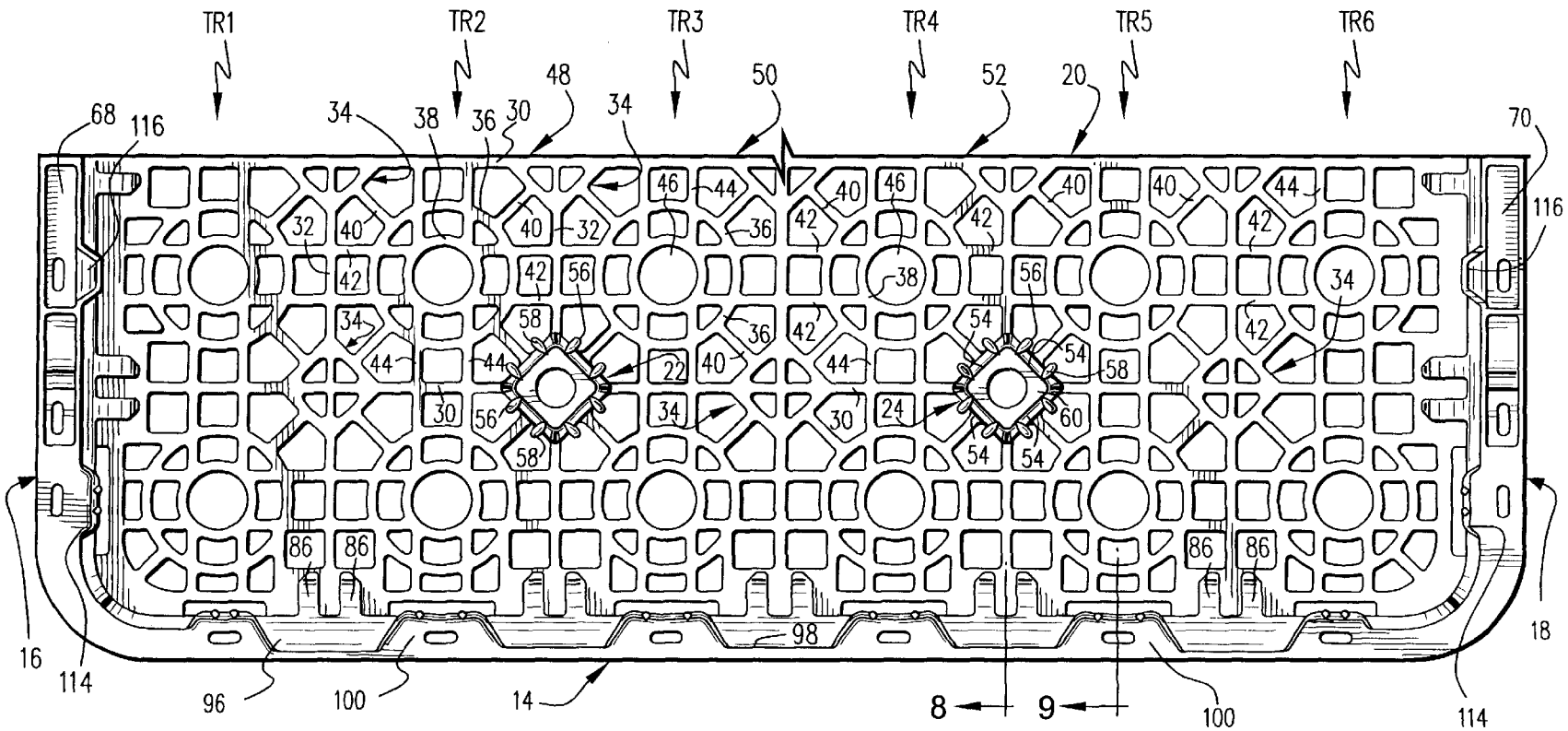
FIG. 2 is a partial plan view of the case shown in FIG. 1.
Figure 3:
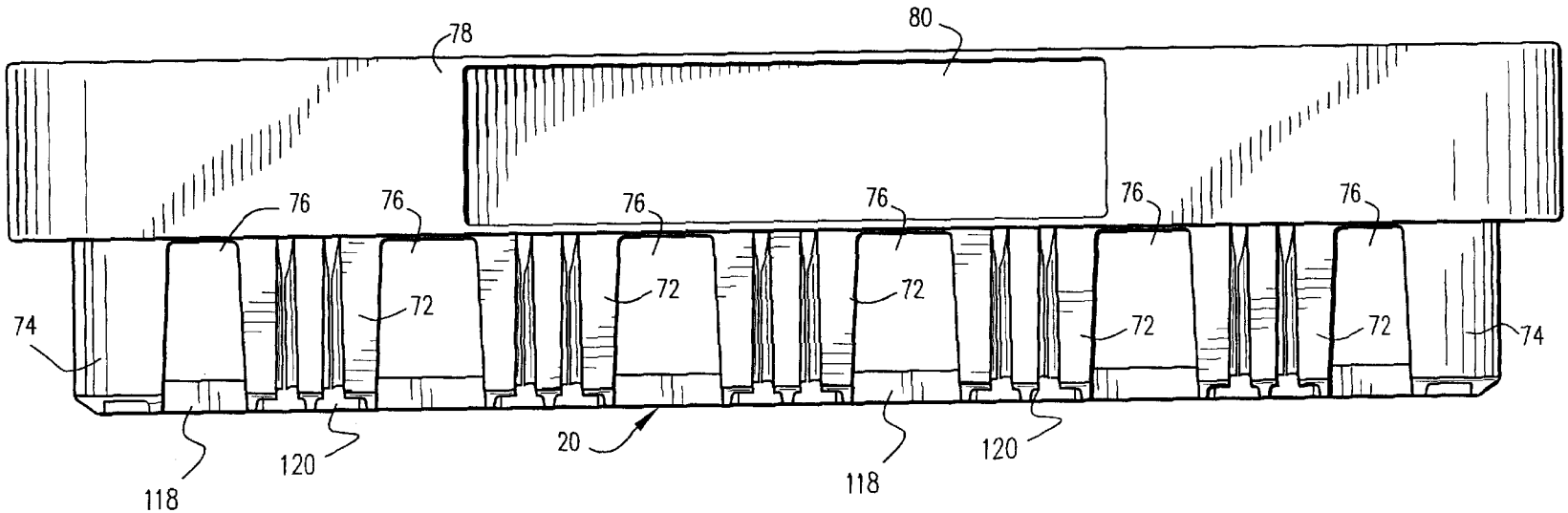
FIG. 3 is a side elevation view of the case illustrated in FIG. 1.
Figure 4:
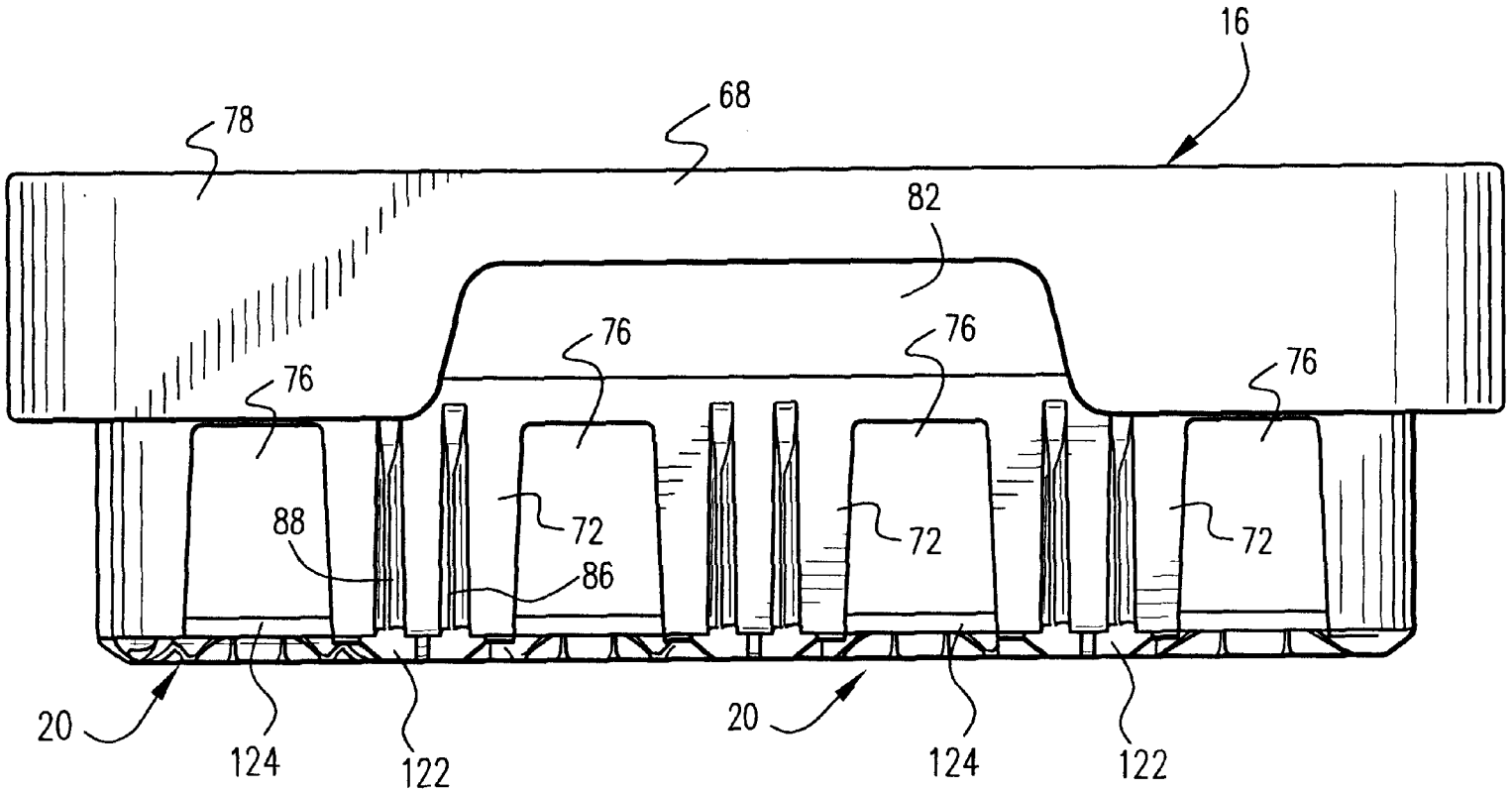
FIG. 4 is an end elevation of the case shown in FIG. 1.

The case bottom 20 is an open grid made up of a pattern of straight and circular ribs. The upper side of the case bottom is flat while the underside is formed with recesses as described further herein. The grid is substantially symmetrical, allowing for slight variations along the side and end walls and in the corners. For the sake of simplicity, only one bottle supporting platform need be described in detail. Thus, as best seen in FIG. 2, each bottle supporting platform is defined by a square made up of longitudinal ribs 30 and transverse ribs 32, with a diamond pattern 34 in each corner (some of which also form part of respective columns 22, 24, 26 and 28). Within the center of each platform, there are a pair of concentric, annular ribs 36, 38. Radial ribs 40 extend from the outer annular ribs 36 to the diamond patterns 34 in respective corners of the platform. It will be appreciated that the ribs 30, 32 and diamond patterns 34 are "shared" with adjacent platforms. In addition, longitudinal and transverse pairs of ribs 42, 44, respectively, extend from the boundary of each platform through the outer annular rib 36 to the inner annular rib 38, centered on the sides of the square platform boundary. Each platform thus has a center hole 46 as defined by the radially inner annular rib 38. For ease of understanding, reference numerals associated with the bottle supporting platform as described above, appear primarily in FIG. 2, and are spread over adjacent platforms, for example, platforms 48, 50 and 52, due to the limited space for the reference numerals.

Figure 5:
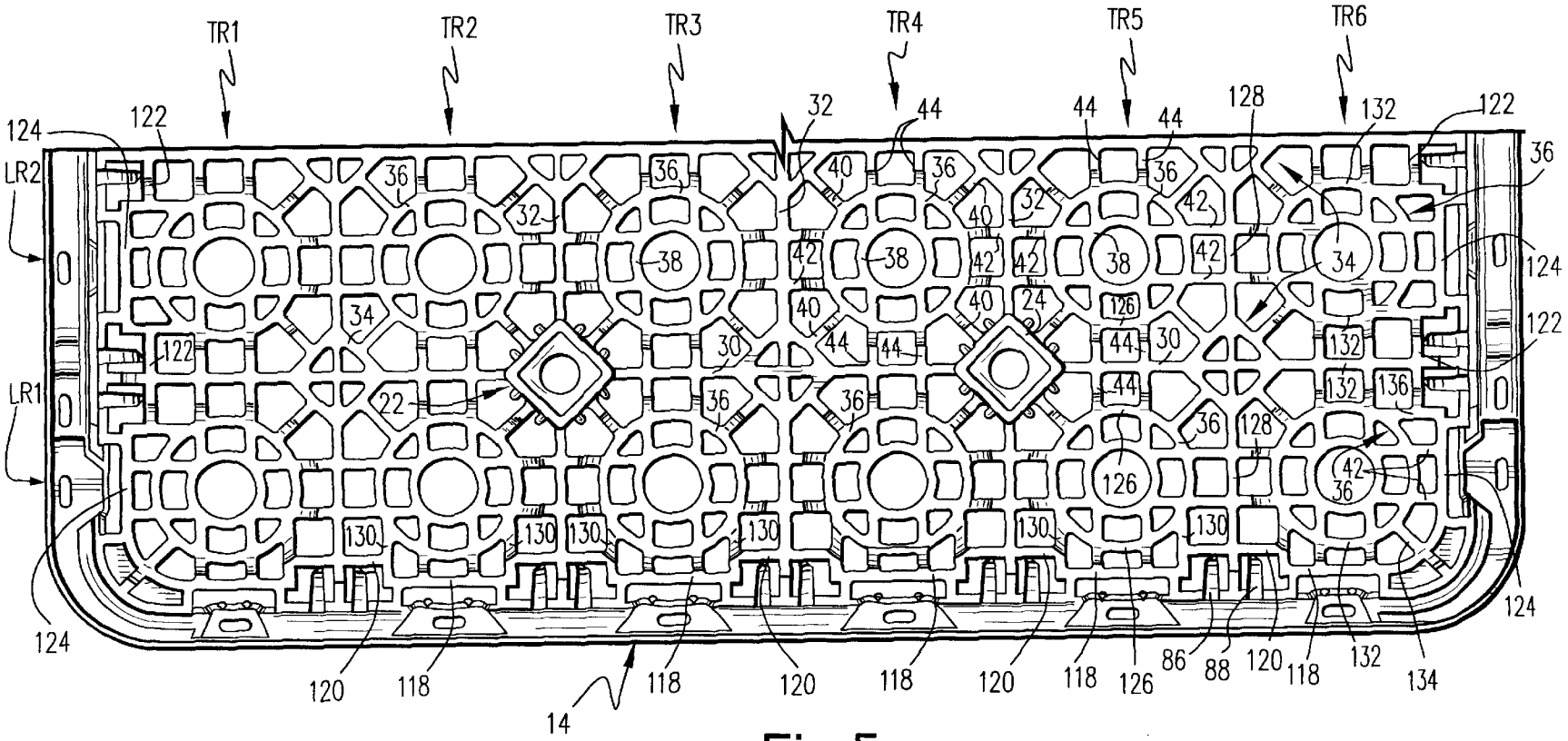
FIG. 5 is a partial bottom plan view of the case shown in Figure

As already mentioned, the upper surface of the case bottom is flat with the exception of the four identical columns 22, 24, 26 and 28. The description below will be primarily with respect to the columns, as best seen in FIGS. 1, 2 and 5.

Each column has four sides 54 of equal width, so that the column walls have essentially a square cross-sectional shape. The sides 54 are oriented similarly to the diamond patterns 34 in the corners of the bottle supporting platforms. As a result, each side 54 faces toward the center of a respective bottle supporting platform. In other words, each side 54 is perpendicular to a line drawn between the center hole 46 of a platform and the center of the respective column. Each of the sides 54 is also formed with a pair of ribs 56, 58 extending upwardly from the case bottom to the top of the column. Note that both the sides 54 of the column 28 and the four pair of ribs 56, 58 taper inwardly at the upper end of the column, terminating at a flat top surface 60, the latter having a center hole 62 formed therein. Each pair of ribs 56, 58 provides line (or tangential) support for a bottle seated in the four adjacent bottle supporting platforms as described further herein.

The side walls 12, 14 and end walls 16, 18 of the case are generally similar except for the presence of handles 68, 70 formed in the end walls. The side and end walls generally have upper and lower sections. The lower section includes a series of spaced panels 72, separated by "windows" 76. The windows 76 extend vertically only to the lower edge of the upper section that is formed as a substantially uniform and continuous solid "band" (except for the handle areas) or rail 78 supported by the panels 72. The band 78, as clearly shown in FIGS. 1, 3 and 4 defines a continuous top edge 79 of the case, having a uniform height. A slightly indented, substantially rectangular region 80 may be formed in the upper band 78, generally centered in each of the side walls 12, 14 for application of labels or other indicia.

The upper band or rail 78 is also formed with handles 82, 84 in the end walls created by through openings in the end walls, to thereby create the respective handles 68, 70, allowing the user to grasp the case at opposite ends.

Figure 6:
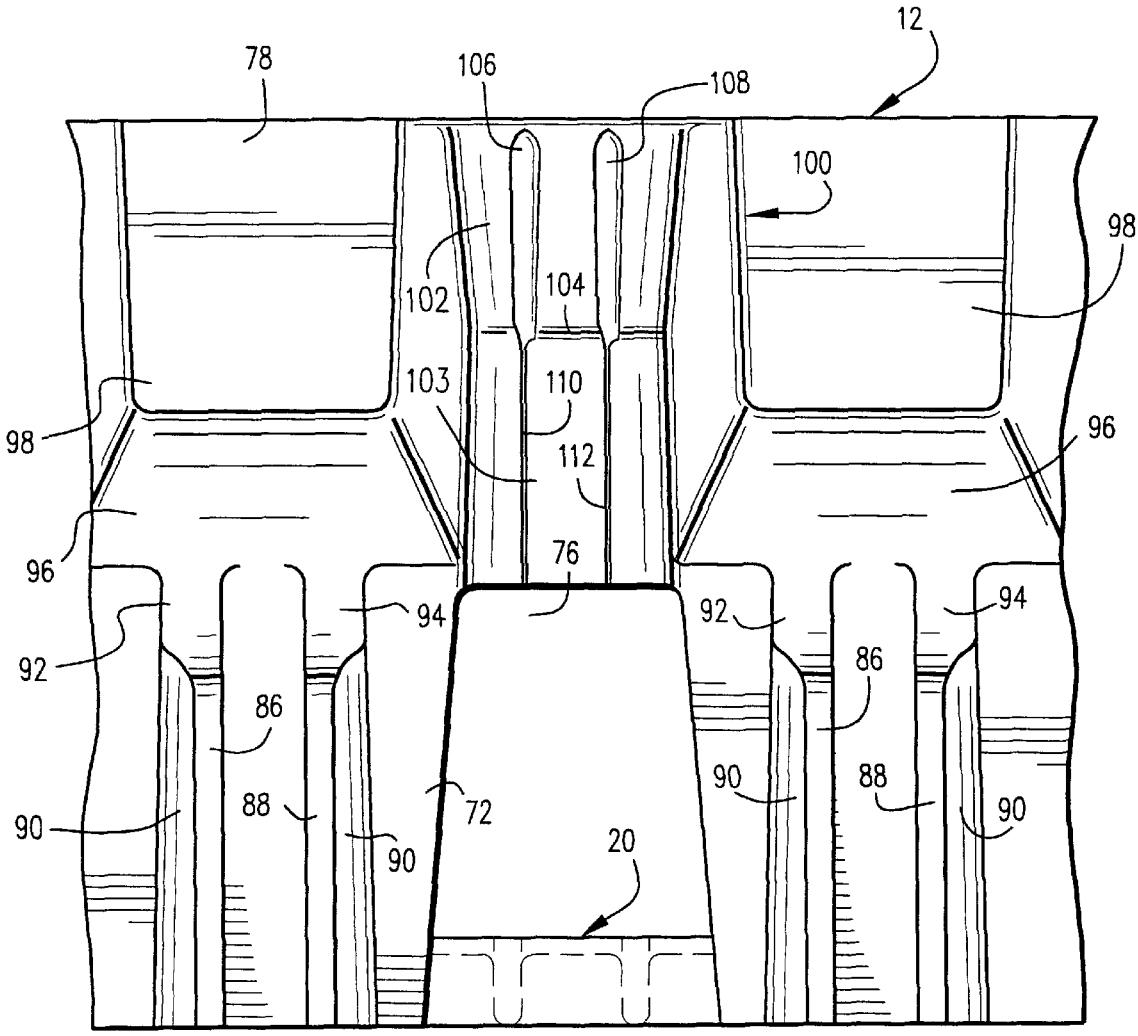
FIG. 6 is an enlarged detail of the interior side wall configuration of the case shown in FIG. 1.
Figure 7:
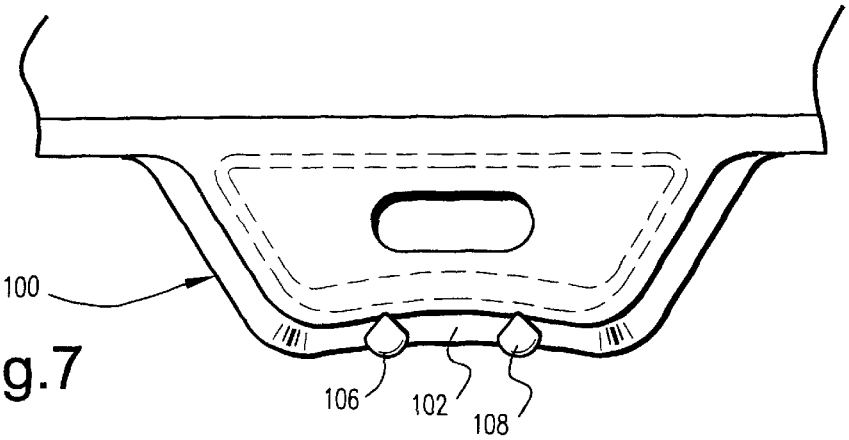
FIG. 7 is an enlarged detail in plan, taken from the side wall in FIG. 1.
Figure 8:
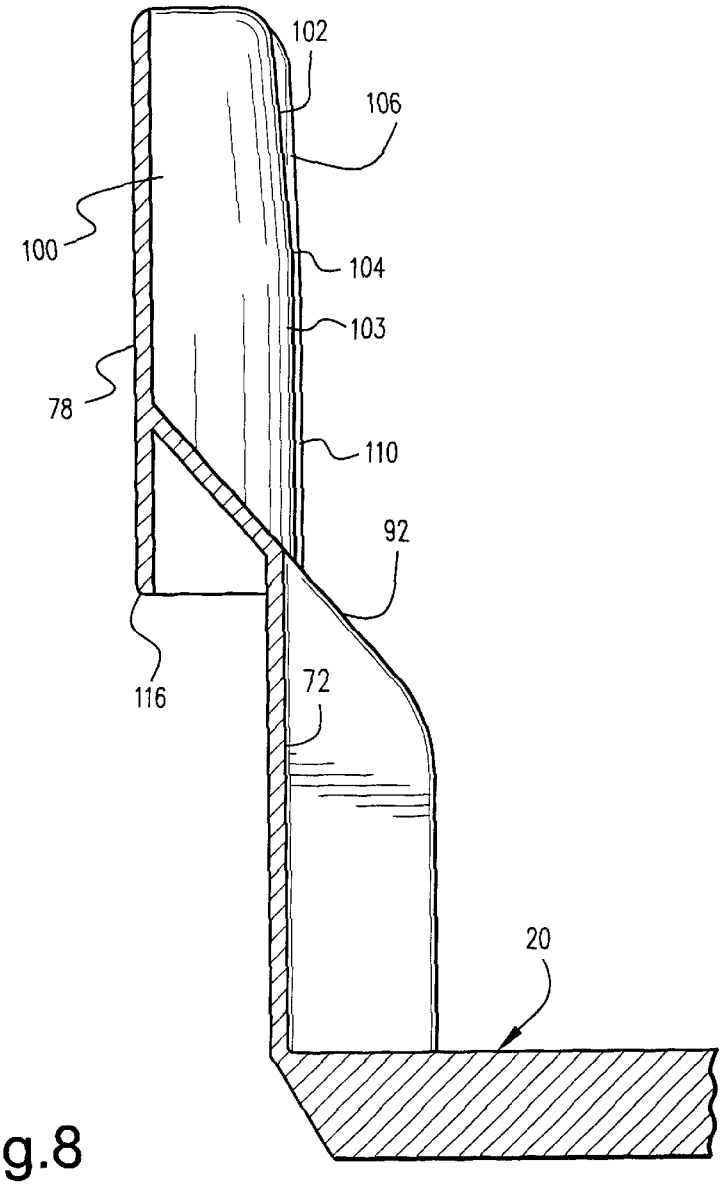
FIG. 8 is a section taken along line 8—8 in FIG. 2.

With reference especially to FIGS. 6 and 8, the interior of the side walls 12, 14 and end walls 16, 18 is formed with a repeating surface pattern configuration in the upper and lower sections thereof. Thus, the interior of each of the panels 72 (except for the panels in the corners of the case) are formed with a pair of inwardly projecting, relatively thick ribs 86, 88. One corner of each rib is formed with a concave bottle engaging edge surface 90 facing radially towards the center of the adjacent bottle supporting platform. In other words, the ribs 86, 88 of each panel 72 support adjacent bottles, whereas the two ribs on either side of a window 76 support the same bottle. The rib surfaces 90 are thin, substantially vertical surfaces with a curvature that generally conforms to the curvature of the bottle.

The upper ends of the ribs 86, 88 included tapered surfaces 92, 94, respectively, that extend upwardly to merge smooth with a tapered surface 96 on the interior of the upper band 78 that, in turn, connects with a vertical surface 98 and that extends to the upper edge of the case.

The interior surface of the corner panels 74 are smoothly curved and are devoid of any ribs or other protrusions, as best seen in FIG. 2.

The interior of the upper band or rail 78 is interrupted by a plurality of spaced, inwardly directed, buttresses 100 (see also FIG. 7), each of which is directly centered over a respective window 76. In other words, buttresses 100 are arranged so as to lie between and above the side wall and end wall panels 72, and extend from the windows 76 to the upper edge of the case. Each buttress 100 is concave in an inward facing direction, and tapers slightly outwardly and upwardly in an upper area 102 delineated by a horizontal crease 104, as best seen in FIGS. 1 and 6–8. This tapered region is provided with a pair of relatively thin, generally vertical ribs 106, 108, each rib having an inwardly facing (i.e., facing into the case interior) convex surface. These ribs are centered with respect to the respective bottle receiving platform. These convex surfaces of ribs 106, 108 thus provide essentially "line" or tangential support for any bottle surface engaged thereby, although these ribs generally do not contact the bottles once they are seated on their respective platforms. They do, however, serve to guide the bottles as they are inserted into the case. The lower area 103 of the buttresses 100, below the crease 104, are vertical and concave, with even thinner vertical ribs 110, 112 continuing from the wider ribs 106, 108, downwardly to the windows 76. These thin vertical ribs 110, 112 provide tangential support for bottles seated on the platforms along the side and end walls of the case.

Similar buttresses 114 are provided on opposite sides of each handle opening 82 and 84, but the width of the end wall buttresses is less than those in the side walls. Nevertheless, the buttresses 114 are also centered with respect to their respective bottle platforms in the corner of the case.

Along each of the handle grip portions 86 and 88, there are a pair of inward facing projections 116 which serve the same purpose as buttresses 100 and 114 and are likewise centered on adjacent bottle support platforms.

Figure 9:
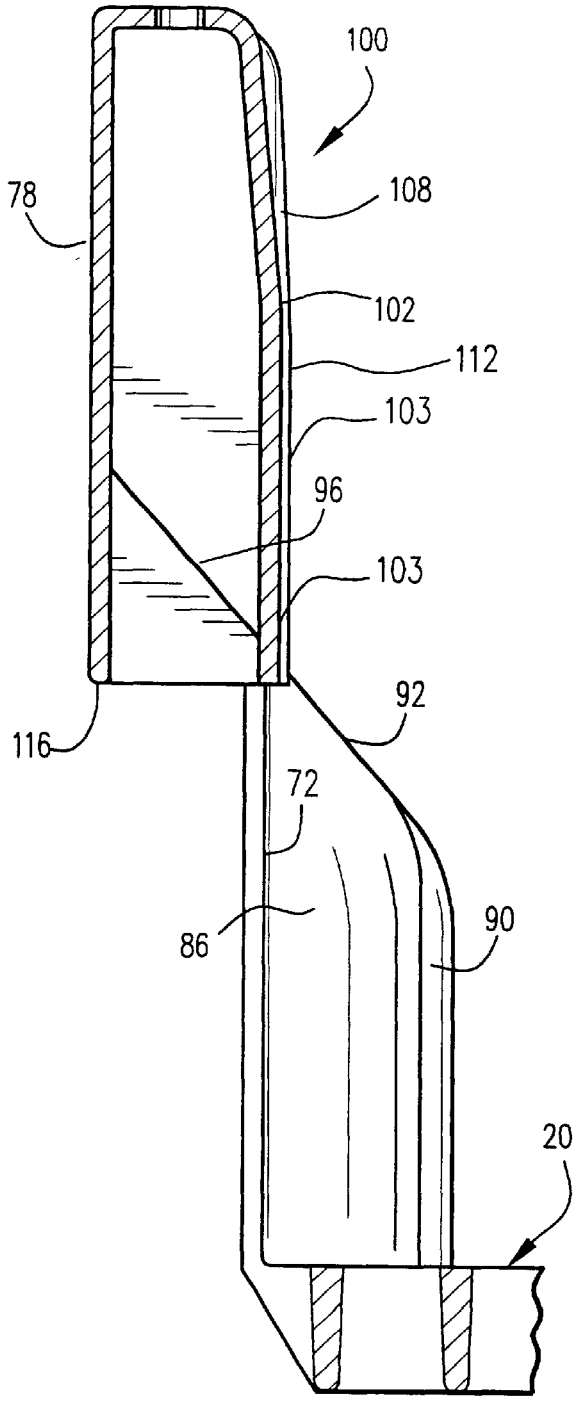
FIG. 9 is a section taken along line 9—9 in FIG. 2.

With specific reference now to FIGS. 8 and 9, it will be appreciated that the upper peripheral rail or band 78 is double wall construction in the area of the buttresses 100, 114 (as defined by band 78 and buttress surfaces 102, 103), and of single wall construction in the areas between the buttresses, (as defined by surfaces 98). The lower panel sections 72, on the other hand, are of single wall construction, noting that the ribs 92, 94 are hollow as evident from the exterior of the panels (see FIGS. 1, 3, 4 and 10). This arrangement results in the upper peripheral rail or band 78 "overhanging" the lower panels 72, and establishing a peripheral edge 116 by which the case is supported when stacked. In other words, the edge 116 of one case rests on the upper edge of an underlying case when stacked empty. The interface along edge 116 provides the only nesting support for adjacent empty cases.

Figure 13:
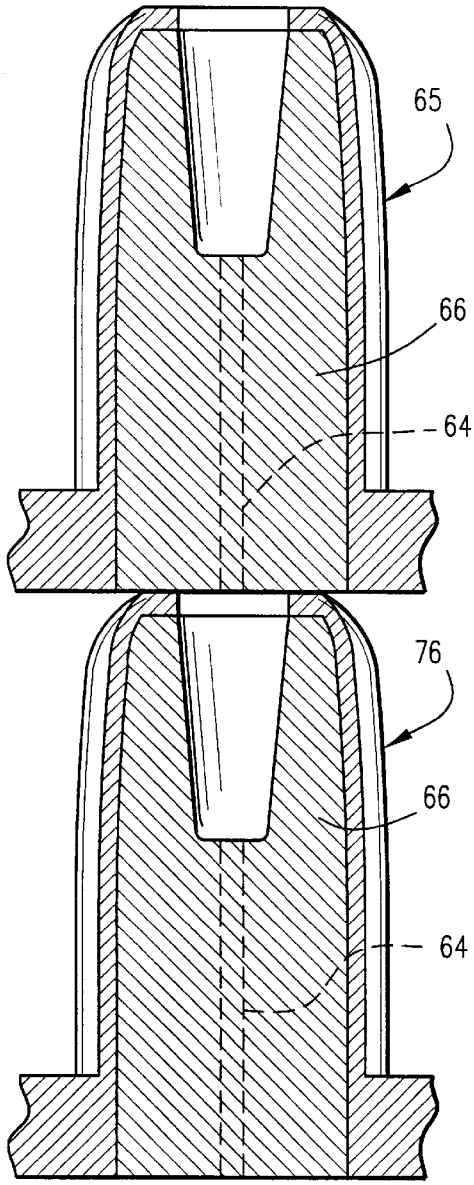
FIG. 13 is a partial section view illustrating the manner in which adjacent cases are supported on each other in accordance with another embodiment of the invention.
Figure 14:
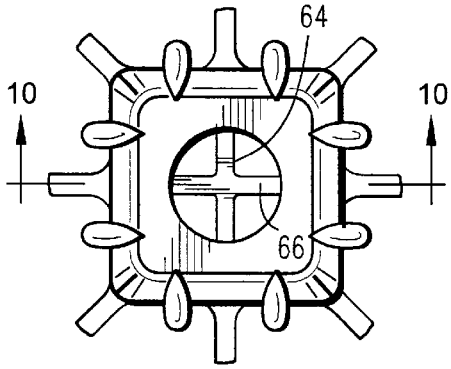
FIG. 14 is an enlarged detail in plan of the column shown in FIG. 13.

As described above, the columns 22, 24, 26 and 28 extend to a height just below the upper edge of the windows 76, and are open at their lower ends. In an alternative embodiment, however, a pair of cross ribs 64, 66 may be provided within the otherwise hollow interiors of columns 65, 67, as best seen in FIGS. 13 and 14. In this case, the columns 65 and 67 are raised in height, extending into the area of the upper peripheral band 78 so that the cross ribs 64, 66 in column 65 of an upper case rest on the tops of the columns 67 of an underlying empty case.

Figure 10:
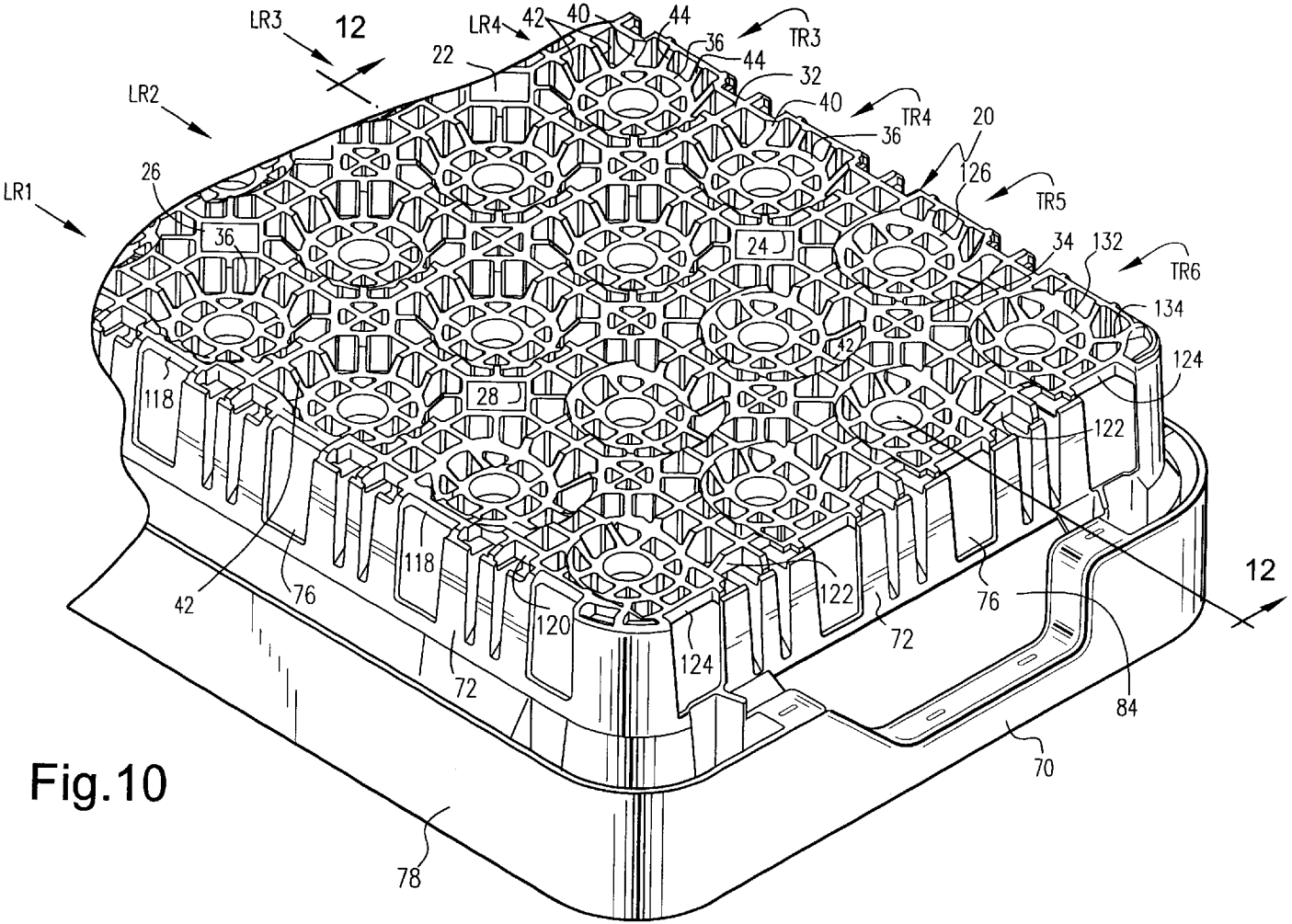
FIG. 10 is a partial perspective view of the bottom of the case shown in FIG. 1.

Turning now to FIGS. 5, 10 and 14, the underside of the case bottom 20 will be described. While the patterns of ribs are identical to the upper side of the case bottom, the underside is not smooth or flat. Rather, the underside is relieved to form pockets for receiving the tops of bottles in underlying cases when two or more of such cases are vertically stacked. For ease of understanding, it is noted initially that the overall recess pattern on the underside of the case bottom 20 is symmetrical, with one half of the case bottom being a mirror image of the other half, using the transverse rib 32 between transverse rows TR3 and TR4 as the center line of the case. Nevertheless, for the respective halves, the platform undersides or recesses in each row is different. Thus, the innermost transverse rows TR3 and TR4 have one underside recess pattern; the intermediate transverse rows TR2 and TR5 have a second underside recess pattern, and outside transverse rows TR1 and TR6 have a third underside recess pattern.

It will be appreciated that the transverse and longitudinal ribs 30 and 32 bordering each platform, as well as the diamond patterns 34 and lowermost edge of the columns 22, 24, 26 and 28, all lie in the same plane and form the lowermost surface of the case bottom 20. This lowermost surface will also be referred to as the bottom plane. Within each platform area, certain additional ribs in the bottom grid also lie in the bottom plane as discussed further below.

As best seen in FIGS. 1 and 5, the bottom grid includes, along the side walls 12 and 14, a plurality of longitudinal rib segments 118, the lower edges of which lie in the bottom plane. These rib segments 118 define the lower edge of the windows 76, and are "set in" relative to the base portions of the lower panels 72. The ribs 118 lie parallel to a plurality of longitudinal rib segments 120 that lie to the inside of the interior ribs 86, 88. Note that transverse ribs 32 intersect the segments 120. Except as noted below, rib segments 118, 120 and ribs 32 lie in the bottom plane. Transverse or end wall rib segments 124 extend along the end walls, similar to longitudinal or side wall rib segments 118 except that, as explained in greater detail below, rib segments 124 lie in the recess plane. Along the end walls, transverse segments 122 correspond to longitudinal segments 120. Note also that the longitudinal rib segments 118 merge with transverse rib segments 124 in the corners of the case, where the side segments 118 taper from the bottom plane to the recess plane as they join with end segments 124. The peripheral edges of the bottom grid where the grid intersects with the exterior surfaces of the side and end panels 72 are beveled to eliminate sharp edges and to facilitate the stacking of empty cases.

Figure 11:
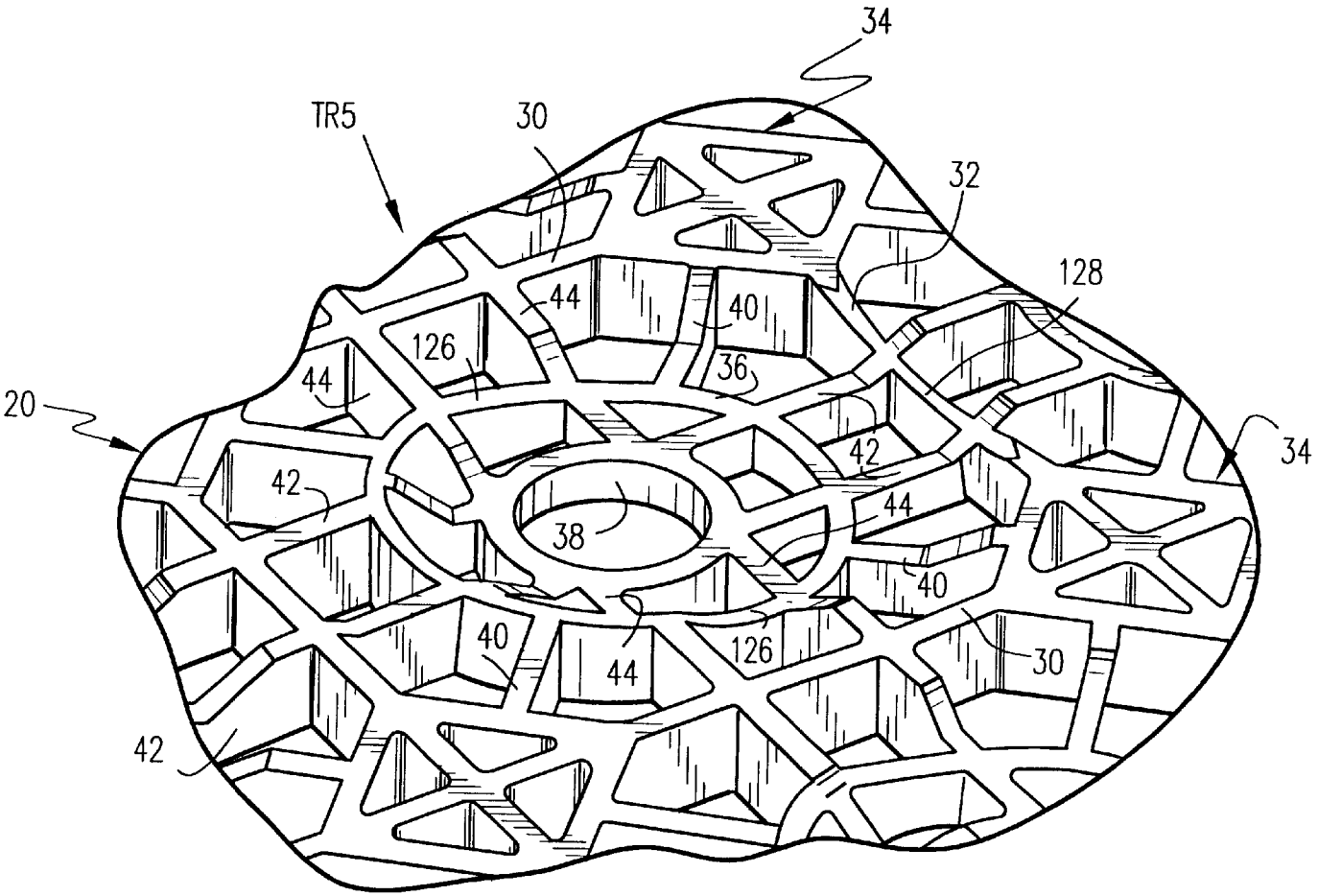
FIG. 11 is an enlarged partial perspective illustrating an asymmetrical recess in the case bottom.
Figure 12:
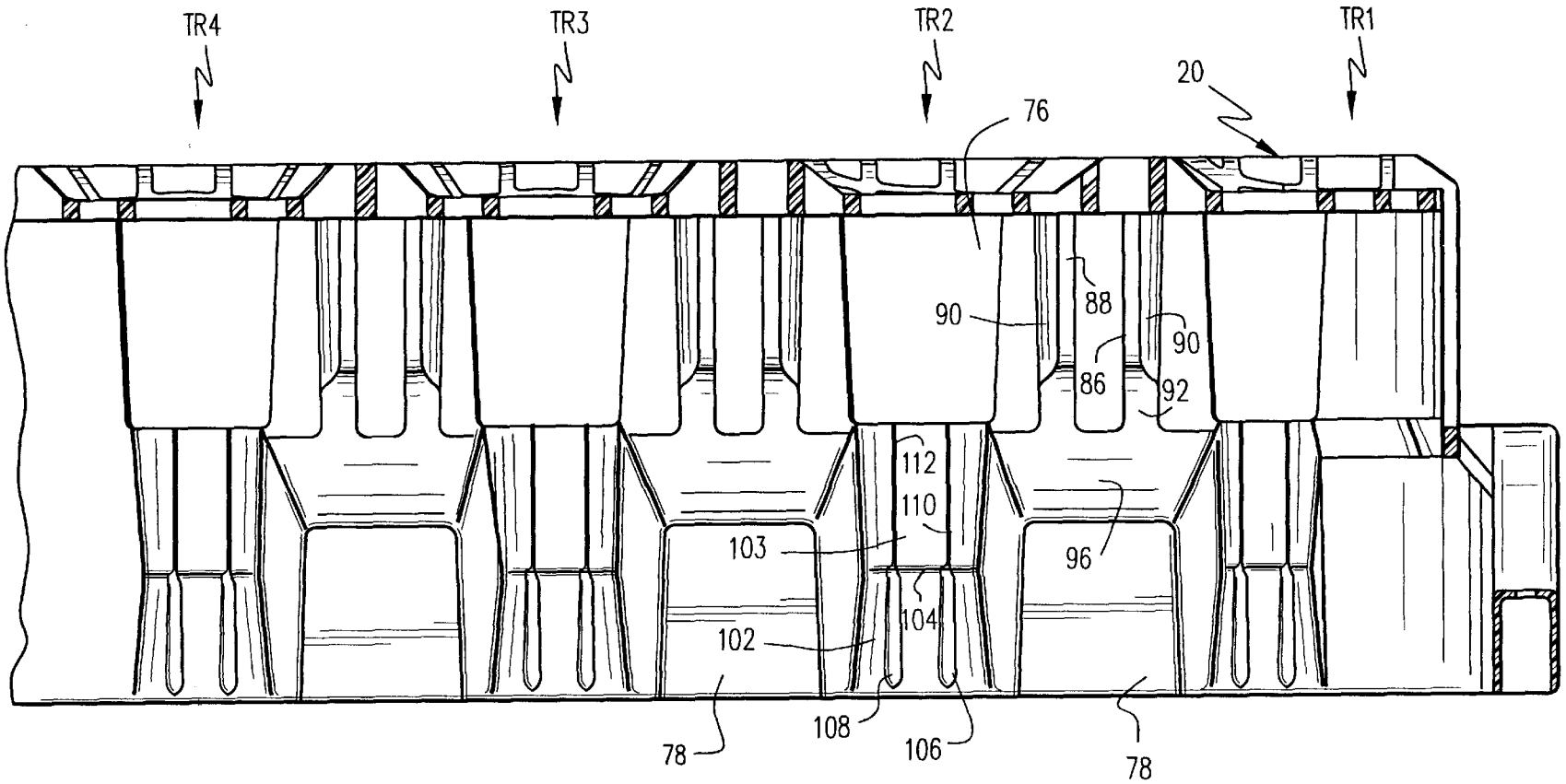
FIG. 12 is a partial section view of the case shown in FIG. 1.

With reference also to FIGS. 11 and 12, in transverse rows $TR_3$ and $TR_4$, the underside of the bottom (under each platform) is formed with a flat recessed area or recess (lying in a "recess plane") bounded by the annular rib 36. Since the diameter of rib 36 is considerably larger than the diameter of a bottle cap, it follows that underlying bottle tops or caps have room to adjust within the circular recessed area. From the rib 36, the surrounding ribs 40, 42 and 44 taper downwardly and outwardly (viewing the case in an upright orientation), terminating in flat portions lying within the bottom plane and connecting to the ribs 30, 32 and diamond pattern 34.

In rows TR2 and TR5, the recesses are modified to facilitate removal of one case from another in a lateral sliding fashion. Specifically, the annular ribs 36 in these rows are lowered (again, considering the case in a normal upright orientation) through approximately 180° so as to lie in the bottom plane. Specifically, annular rib 36 moves from the recess plane to the bottom plane via diametrically opposed opposite taper or ramp portions 126, extending between respective pairs of transverse ribs 44. The portion in the bottom plane is that part closer to the center line 32 of the case. To the right of annular rib 36 on the platform TR5 (as viewed in FIGS. 5 and 11), the pair of longitudinal ribs 42 remain substantially in the recess plane, tapering slightly to meet the transverse rib 32. Note that between the diamond patterns 34 to the right of the recess on the platform at TR5, LR2, the transverse rib 32 is shaved to include a center section 128 (between the ribs 42) that lies between the recess plane and the bottom plane. The pair of ribs 42 continue to taper through the rib 32 downwardly to the bottom plane in the adjacent platforms in TR6).

For the recesses at LR1, TR2 and TR5; and LR4, TR2 and TR5, a similar shaved section 128 of the transverse rib 32 extends between diamond pattern 34 and one of the longitudinal rib segments 120 at the base of the ribs 86, 88 closest the end wall. Note also that for longitudinal rows TR1 and TR4, the radial ribs 40 that would otherwise be closest the side walls 12 and 14 are replaced by transverse rib segments 130 that intersect the annular rib 36 and that connect the offset longitudinal rib segments 118 and 120. Segmented rib 118 at TR5 (and TR2) tapers from the shaved transverse rib 32 toward the recess plane as it intersects the rib segment 130. At the same time, radial rib 40 (on the right hand side of the platforms in TR5 and TR2) extends from annular rib 36 farther in the recess plane than corresponding radial ribs 40 in TR4 before tapering to the bottom plane at the diamond pattern 34. The result of this configuration is that the recesses in platforms in TR5 (and TR2) are elongated toward the nearest end of the case and are thus asymmetrical with respect to the platform itself. This arrangement facilitates sliding of the case in a direction parallel to the longitudinal axis of the case, recognizing that the case must slide over bottle caps received in the various recesses.

In row TR6 (and TR1), the recess is continued in the recess plane to the end edge of the case. Specifically, the annular rib 36 is identical to that in TR5 (and TR2), with diametrically opposed tapers at 132 leading from the bottom plane to the recess plane. The longitudinal rib pair 42, 42; corner radial rib 134, longitudinal rib segment 136, and the end rib segments 124 all lie in the recess plane, providing clear and open access to the recesses in TR6 (and TR1). Here again, the goal is to facilitate sliding the case off a stack of cases. This is especially important when the handler must reach above his or her head to grasp the top case in the stack and slide it off the stack.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A case for carrying a plurality of bottles taller than the case comprising a pair of side walls and a pair of end walls connected to a case bottom having a plurality of bottle supporting platforms, said side walls and said end walls having a lower part including a plurality of flat panels separated by windows and an upper part including a substantially solid peripheral band extending about a periphery of the case and defining a continuous top edge of uniform height, said windows centered on said bottle receiving platforms and open between said case bottom and said solid peripheral band; and wherein said solid peripheral band is provided with handle-forming openings in said end walls; and further wherein a flat interior surface of each of said flat panels includes a pair of adjacent, relatively thick, vertically extending ribs, said ribs projecting inwardly from said flat interior surface and each rib having one concave corner edge facing radially towards a center of a respective adjacent bottle supporting platform.

2. The case of claim 1 wherein said upper part of said side walls and said end walls has an exterior surface lying outside said panels, thereby permitting two or more empty cases to be stacked in a nested fashion.

3. The case of claim 1 wherein an upper surface of said case bottom is substantially flat.

4. The case of claim 3 wherein a lower surface of said case bottom lies in a bottom plane and wherein recesses are formed in the case bottom aligned with said bottle supporting platforms and lying in a recess plane.

5. The case of claim 4 wherein said recesses are symmetrical about a transverse center line of the case but are asymmetrical with respect to transverse rows in each half of the case.

6. The case of claim 5 wherein the recesses are progressively open in directions parallel to the longitudinal axis of the case toward opposite ends of the case.

7. A low depth case for carrying a plurality of bottles taller than the crate comprising a pair of side walls and a pair of end walls connected to a case bottom having a plurality of bottle supporting platforms, said side walls and said end walls having a lower part including a plurality of flat panels separated by windows centered in said bottle receiving platforms, and an upper part including a substantially continuous, solid band of uniform height, said solid band in said end walls having handle-forming through openings therein to thereby define a respective pair of handles; wherein said flat panels in said side walls and said end walls are each provided on a flat interior surface thereof with a pair of adjacent, relatively thick, vertically extending ribs, said ribs projecting inwardly from said interior surface and each rib having one concave corner edge facing radially towards a center of an adjacent bottle supporting platform; wherein said solid band ins aid side walls and said end walls is provided on an interior surface thereof with a plurality of vertically extending buttresses, each directly above a respective window, and each having an inwardly facing concave surface.

8. The case of claim 7 wherein each of said buttresses is provided with a pair of vertically extending ribs centered on an adjacent bottle supporting platform.

9. The case of claim 8 wherein said inwardly facing concave surface is on a substantially vertical lower part of said buttress, said buttress also having an upper part that tapers outwardly in an upward direction.

10. The case of claim 9 wherein said upper part is also formed with an inwardly facing concave surface.

11. The case of claim 7 and further comprising a plurality of interior columns extending upwardly from said case bottom within an area defined by said side walls and said end walls, none of said columns located along longitudinal and transverse center axes of the case.

12. The case of claim 11 wherein each said interior column provides support for bottles on four adjacent bottle receiving platforms.

13. The case of claim 12 wherein each interior column includes four faces, each face oriented substantially perpendicular to a radial line drawn from a center of an adjacent platform each face having a pair of substantially vertical ribs extending therealong.

14. The case of claim 11 wherein said columns extend no higher than said windows.

15. The case of claim 11 wherein said columns extend to a height between said windows and an upper edge of the case.

16. A low depth case for carrying a plurality of bottles comprising a pair of side walls and a pair of end walls connected to a case bottom having a plurality of bottle supporting platforms, said side walls and said end walls having a lower part including a plurality of flat panels separated by windows, and an upper part including a substantially continuous, solid band, said solid band in said end walls having handle-forming through openings therein; wherein said flat panels are each provided on a flat interior surfaces thereof with a pair of adjacent, relatively thick, vertically extending ribs, said ribs projecting inwardly from said flat interior surface and each rib having one concave corner edge facing radially towards a center of an adjacent bottle supporting platforms; and further comprising a plurality of interior columns extending upwardly from said case bottom and spaced inwardly from said side walls and said end walls, none of said columns located along longitudinal and transverse center axes of the case.

17. The case of claim 16 wherein each said interior column provides support for bottles on four adjacent bottle receiving platforms.

18. The case of claim 17 wherein each interior column includes four faces, each face oriented substantially perpendicular to a radial line drawn from a center of an adjacent platform each face having a pair of substantially vertical ribs extending therealong.

19. The case of claim 16 wherein said columns extend no higher than said windows.

20. The case of claim 16 wherein said columns extend to a height between said windows and an upper edge of the case.

21. The case of claim 19 wherein said columns are hollow and include mutually perpendicular ribs therein.

22. A case for carrying a plurality of bottles comprising a pair of side walls and a pair of end walls connected to a case bottom having a plurality of bottle supporting platforms, said side walls and said end walls having a lower part including a plurality of flat panels separated by windows and an upper part including a substantially solid band extending about the periphery of the case and defining a continuous top edge of the case of uniform height, said solid band provided with handle-forming openings in said end walls; and wherein said solid band is provided on an interior surface thereof with a plurality of vertically extending buttresses, each directly above a respective window; and further wherein each of said buttresses includes a concave surface extending vertically in a lower portion of said buttress and tapered outwardly in an upper portion of said buttress, with a pair of vertically extending convex ribs on said concave surface extending along both of said upper and lower portions of said buttress, and centered on an adjacent bottle supporting platform.

23. The case of claim 22 wherein said upper part of said side walls and said end walls has an exterior surface lying outside said panels, thereby permitting two or more empty cases to be stacked in a nested fashion.

24. The case of claim 22 wherein an upper surface of said case bottom is substantially flat.

25. The case of claim 22 wherein a lower surface of said case bottom lies in a bottom plane and wherein recesses are formed in the case bottom aligned with said bottle supporting platforms and lying in a recess plane.

26. The case of claim 22 and further comprising a plurality of columns extending upwardly from said case bottom within an area defined by said side walls and said end walls, none of said columns located along longitudinal and transverse center axes of the case.

27. A The case of claim 26 wherein said column provides support for bottles on four adjacent bottle receiving platforms.

28. The case of claim 27 wherein each column includes four faces, each face oriented substantially perpendicular to a radial line drawn from a center of an adjacent platform, each face having a pair of substantially vertical ribs extending therealong.

29. The case of claim 25 wherein said recesses are symmetrical about a transverse center line of the case but are asymmetrical with respect to transverse rows in each half of the case.

30. The case of claim 29 wherein the recesses are progressively open in directions parallel to the longitudinal axis of the case toward opposite ends of the case.

31. The case of claim 26 wherein said columns extend no higher than said windows.

32. The case of claim 26 wherein said columns extend to a height between said windows and an upper edge of the case.

33. The case of claim 32 wherein said columns are hollow and include mutually perpendicular ribs therein.

34. The case of claim 22 wherein said vertically extending ribs are thicker in said upper part than in said lower part.

* * * * *